United States Patent [19]

Sekitani et al.

[11] Patent Number: 4,674,636

[45] Date of Patent: Jun. 23, 1987

[54] BOBBIN REMOVING APPARATUS

[75] Inventors: Noboru Sekitani; Hiroo Otoshima, both of Shiga, Japan

[73] Assignee: Murata Kikai Kabushiki Kaisha, Kyoto, Japan

[21] Appl. No.: 782,994

[22] Filed: Oct. 2, 1985

[30] Foreign Application Priority Data

Oct. 2, 1984 [JP] Japan ..... 59-206938

[51] Int. Cl.[4] ..... B07C 5/36; B65H 67/06

[52] U.S. Cl. ..... 209/600; 198/604; 198/627; 209/927; 242/35.5 A; 414/416

[58] Field of Search ..... 209/600, 617, 629, 555, 209/700, 927, 656; 414/403, 416, 417; 242/35.5 A; 198/803.12, 604, 597, 598, 469.1, 627

[56] References Cited

U.S. PATENT DOCUMENTS

| | | | |
|---|---|---|---|
| 3,170,564 | 2/1965 | Gatto | 198/627 |
| 3,339,710 | 9/1967 | Micgielse et al. | 198/836 |
| 3,405,877 | 10/1968 | Jenny | 209/927 |
| 3,495,696 | 2/1970 | Molins et al. | 198/604 |
| 3,563,376 | 2/1971 | Zegna | 209/600 |
| 4,061,236 | 12/1977 | Schneerson | 414/416 |
| 4,173,278 | 11/1979 | Reitter | 198/627 |
| 4,457,422 | 7/1984 | Hard | 198/604 |
| 4,598,869 | 7/1986 | Uchida et al. | 209/927 |

FOREIGN PATENT DOCUMENTS

| | | | |
|---|---|---|---|
| 1079305 | 11/1954 | France | 198/604 |

*Primary Examiner*—Robert B. Reeves
*Assistant Examiner*—Donald T. Hajec
*Attorney, Agent, or Firm*—Spensley Horn Jubas & Lubitz

[57] ABSTRACT

A bobbin removing apparatus for an automatic winding system comprising a running belt and a bobbin guide member confronting with the belt, the apparatus being so constructed that a bobbin is tightly caught between the belt and the guide member and removed from a bobbin conveying medium by utilization of the motion of the belt.

11 Claims, 11 Drawing Figures

BOBBIN REMOVING APPARATUS

BACKGROUND OF THE INVENTION

1. Field of the Invention

The present invention relates to a bobbin removing apparatus in an automatic winding system.

2. Prior Art

A system for feeding spinning bobbins from a spinning machine to an automatic winder is known wherein each spinning bobbin is fitted uprightly over a conveyance medium (referred to hereinafter as a bobbin tray) with a peg and separately supplied to a winding unit. Empty bobbins are discharged from the winding unit while remaining fitted on the bobbin trays and then subsequently separated from the bobbin trays. The unloaded bobbin trays are then resupplied with spinning bobbins and delivered to the winder.

For removing an empty bobbin from a bobbin tray, the bobbin may be held at the top by the holding member of a moving-up-and-down bobbin chuck. The bobbin is raised and, upon reaching a predetermined position, is released from the held condition and falls down an appropriate chute, or the like.

This type of system has the disadvantage that, since the bobbin chuck rises or falls in a certain stroke, it is necessary to vary the rising and falling stroke with the size or length (usually 200 to 300 mm) of the bobbin. There is also a danger that the chuck will miss when the leading end of the bobbin is not in position. Additional disadvantages are that the movement of the bobbin chuck includes the process consisting of falling-holding-rising-release, and that the throughput is at most 20 to 30 bobbins per minute.

SUMMARY OF THE INVENTION

An object of the present invention is to provide a bobbin removing apparatus in which different types of bobbins can be handled and the time required for the removing cycle may be reduced.

The apparatus according to the invention comprises a belt conveyor running in one direction and bobbin guides disposed along and adjacent to the conveyance surface of the belt. The apparatus is so constructed that a bobbin is tightly caught between the belt and the bobbin guides and removed from the conveyance medium by utilization of the motion of the belt.

Bobbins on bobbin trays are separated from the trays and caused to rise while tightly caught between the belt and bobbin guides, and delivered to the appropriate discharge chute.

PREFERRED EMBODIMENTS OF THE INVENTION

Figure 1A:
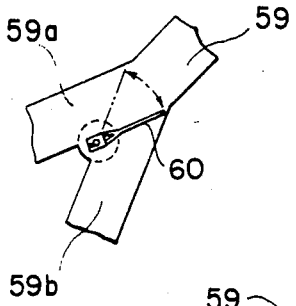
FIG. 1A is a partial plane view showing a bifurcated chute.
Figure 1:
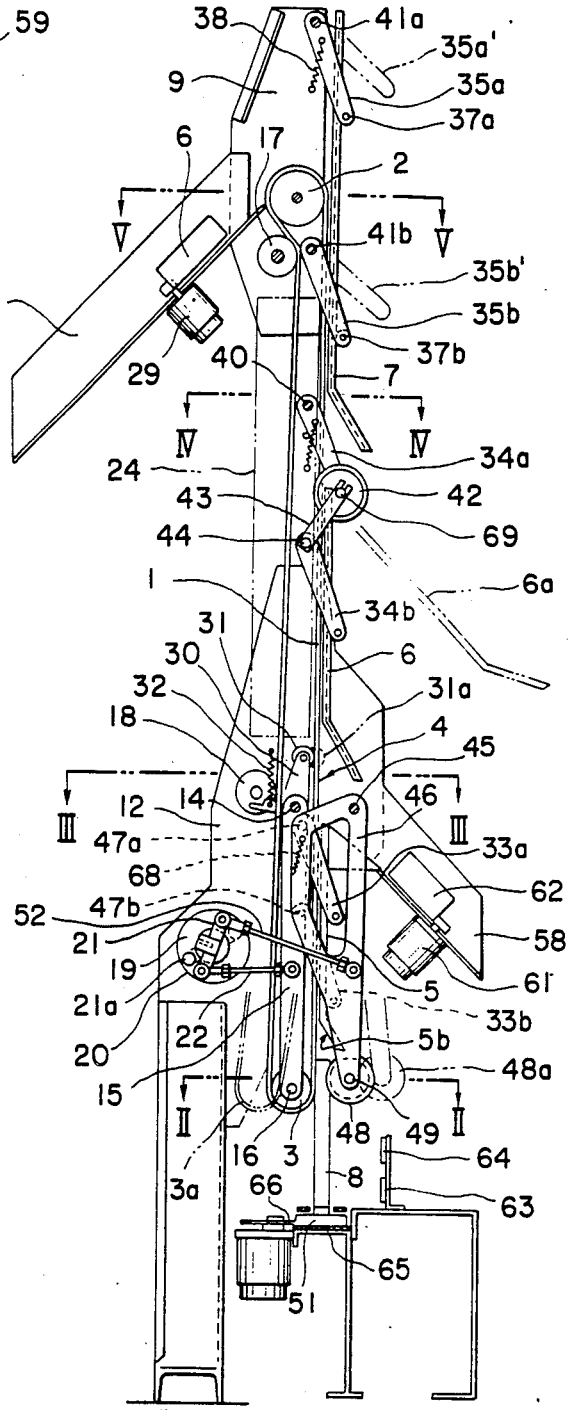
FIG. 1 is an elevational view of an embodiment of the apparatus according to the invention.
Figure 4:
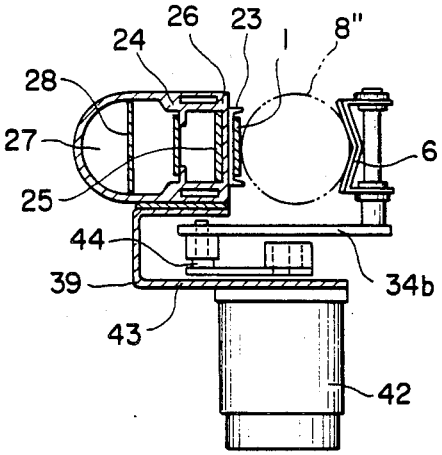
FIG. 4 is a cross-sectional view taken along line IV—IV of FIG. 1.

The invention will be described more fully by way of examples with reference to the accompanying drawings hereinafter:

In FIG. 1, the reference character 1 designates a vertically running endless belt 1 wound around a pair of pulleys (upper and lower pulleys) 2 and 3. Along and adjacent the conveyance surface of the belt 1, there are provided bobbin guide plates 5, 6 and 7 for forcing bobbins against the belt. The guides plates are constructed so that they are allowed to open and close with respect to the belt. A bobbin 8, which may be tightly caught between the belt 1 and the guide plates 5, 6, 7, as illustrated in FIG. 4, is thereby separated and conveyed upwards with the motion of the belt 1.

Figure 5:
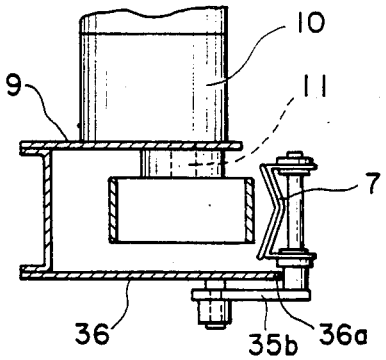
FIG. 5 is a cross-sectional view taken along line V—V of FIG. 1.

The upper pulley 2 carrying the belt 1 is fixedly mounted on the output shaft 11 of a motor 10 installed on a fixed frame element 9 (FIG. 5). The lower pulley 3 is pivotally connected to the lower end 16 of a movable bracket 15. The bracket is at the upper end pivotally mounted on a shaft 14 supported at the ends by frame elements 12 and 13. Reference numerals 17, 18 designate tension pulleys. The conveyance surface 4 of the belt 1 is in substantially vertical position as shown by the solid line in FIG. 1. A rod 22 is connected at one end to the movable bracket 15 carrying the lower pulley 3 and at the other end to one end of a lever 21. The lever is made integrally with the shaft 20 of a rotary solenoid 19. The mechanism ensures that the rotary solenoid 19 actuates the lower pulley 3 to shift between a position indicated by the dash-and-two-dots line 3*a* and another position indicated by the solid line 3 in FIG. 1. On the back of the belt 1 opposite to the conveyance surface, as shown in FIGS. 1 and 4, the belt-guide plate 23 for preventing the belt 1 from being flexed is secured to a holder 24 with holding members 26 holding the belt-guide plate 24 between them through a metal fixture 25. As shown in FIG. 4, the holder 24 is provided with a hole (which leads to a motor 10 and a solenoid 29) illustrated in FIGS. 1 and 5 which is defined by the portion 27 of the holder and a partition 28.

The shaft 14 located at the middle position of the belt 1 shown in FIG. 1 carries a two-arm lever 30 pivoted thereon. The lever 30 carries at one end a pulley 31 and is connected at the other end to a spring 32 hooked to the frame element 12. The pulley 31 is thereby urged against the back of the belt 1 by the spring.

Figure 2:
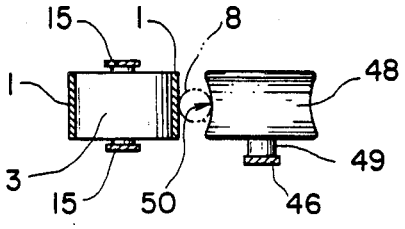
FIG. 2 is a cross-sectional view taken along line II—II of FIG. 1.
Figure 3:
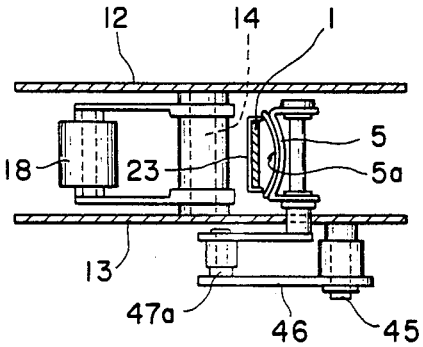
FIG. 3 is a cross-sectional view taken along line III—III of FIG. 1.

On the other hand, the separate guide plates 5, 6, 7 located along and adjacent to the conveyance surface of the belt 1 are each designed to be displacable parallel to the conveyance surface 4 through the intermediation of linked pairs 33*a*, 33*b*; 34*a*, 34*b*; or 35*a*, 35*b*. In FIGS. 1 and 5, the upper guide plate 7 is pivotally connected to ends 36*a*, 36*b* of turnable links 35*a*, 35*b*, respectively. The links are pivoted on shafts 41*a*, 41*b* journalled in the frame element 36. There is provided a spring 38 between the link 35*a* and the frame element 36, which urges the guide plate 7 towards the conveyance belt surface 4. The link 35*b* abuts the projecting portion 36*a* (FIG. 5) of the frame 36 to limit the approach. The guide plate 7 carried by the links 35*a*, 35*b*, as shown in FIG. 5, has a cross-section of V-form so that a bobbin is caught tightly between the belt 1 and the guide plate 7. Only one link 34*a* for the middle guide plate 6 is mounted on a shaft 40 journalled in a frame element 24. The other link 34*b*, as shown in FIGS. 1 and 4, is mounted on a shaft 44 journalled in the arm 43 of a rotary solenoid 42 attached to the bracket 39. By the operation of the rotary solenoid 42, the guide plate 6 can be caused to turn to the position indicated by the dash-and-two-dots line 6*a*. Besides, the lower guide plate 5, as apparent from FIGS. 1 and 3, is mounted on shafts 47*a*, 47*b*, which are journalled in a swinging plate 46 at two positions. The swinging plate 46 is pivoted on a shaft 45 fixedly secured to the frame element 13. Thus the lower guide plate 5 is turnable together with the swinging plate 46 and movable parallel to the swinging plate 46. The lower end portion of the swinging plate 46 is connected to a roller 48 which is mounted rotatably on a common shaft 49 and which forces a bobbin 8 against the belt 1. The roller 48, as shown in FIGS. 1 and 2, is provided on the rim with a groove 50 having a bow-shaped cross-section, which abuts on the periphery of the bobbin 8 to permit the separation of a bobbin 8 from the tray 51. Also, the center of the swinging plate 46 is connected to one end of a rod 52, which connects to the lever 21 of the rotary solenoid 19 to permit opening and closing motion at right to the advancing direction of the bobbin by the operation of the rotary solenoid 19 operably associated with the swing of the bracket 15. Thus the roller 48 is shiftable between the position 48*a* indicated by the dash-and-two-dots line and the position 48 indicated by the solid line.

The lower guide plate 5, as shown in FIG. 3, unlike the guide plates 6, 7, has a guide surface 5*a* of circular arc in cross-section. At the center of the guide plate 5, there is provided a feeler 53 for detecting a bobbin with a very small amount of remaining yarn thereon. The detection device is, for example, so constructed that, referring to FIG. 6, a brush-shaped member projecting from the notch 54 towards the guide surface is attached to the rotary shaft 55. When a bobbin is being raised, the remaining yarn on the bobbin is brought into engagement with the brush, resulting, in turn, in angular displacement of the feeler 53 accompanied by horizontal shaft 55, and in operation of an approach switch 57 through the action of an ion piece 56. Detection of the bobbin with thread remaining thereon is thus performed. Therefore, if a bobbin 8 is caused to rise with its periphery placed in tight contact with the guide surface 5*a* of the guide plate 5, failure to detect remaining yarn can be prevented. The sensor or switch 57 controls turning of the middle guide plate through the operation of the rotary solenoid 42. In the present embodiment, when remaining yarn is detected on a bobbin checked, the rotary solenoid 42 is caused to operate to discharge the bobbin down the middle chute 58.

On the other hand, an empty bobbin is caused to rise along the belt 1 to the upper end where it may be discharged down the chute 59. When bobbins of the same type are conveyed, the above-mentioned chutes 58, 59 may be designed as straight chutes. When bobbins of two different types are conveyed, a bifurcated chute may be used for the chute 59. As illustrated in FIG. 1A, the bifurcated chute 59 may include two chute members 59*a*, 59*b* and a shiftable guide 60 located at the juncture between the chute members. The guide 60 may be switched between two positions by the action of a rotary solenoid 29 in accordance with the type of bobbin, so that one type of bobbin may be separated from the other type of bobbin and discharged down the chute 59 to a store box or a conveyor for storage or conveying out. Likewise the chute 58 may include a shiftable guide 62 actuated by a rotary solenoid for separating different bobbins. The detection of the type of the bobbin may be performed, for example, in such a way that the color of a tray 51 for carrying a standing bobbin fitted therein corresponds to the type of the bobbin. For instance, a black tray may correspond to bobbin type A and a white tray may correspond to bobbin type B. The color of the tray is read by a mark sensor, and thereby the aforesaid shiftable guide is controlled to be properly positioned. In this way, it is possible to sort bobbins.

In addition, in FIG. 1, there are provided at the bobbin removing position, respective sensors 63 and 64 for detecting trays 51 and bobbins 8, for which photoelectric sensors or the like can be used. There may further be provided a sensor (not shown) for detecting bobbins having many layers or residual yarn thereon. For such sensor one may use, for example, a feeler which is displaced by the resistance of the yarn layer when a bobbin carrying residual yarns remaining thereon passes by the sensor, but which is not displaced when a bobbin carrying no or a very small amount of remaining yarn thereon passes by the sensor; or a photoelectric tube sensor for detecting a yarn layer portion.

Figure 7:
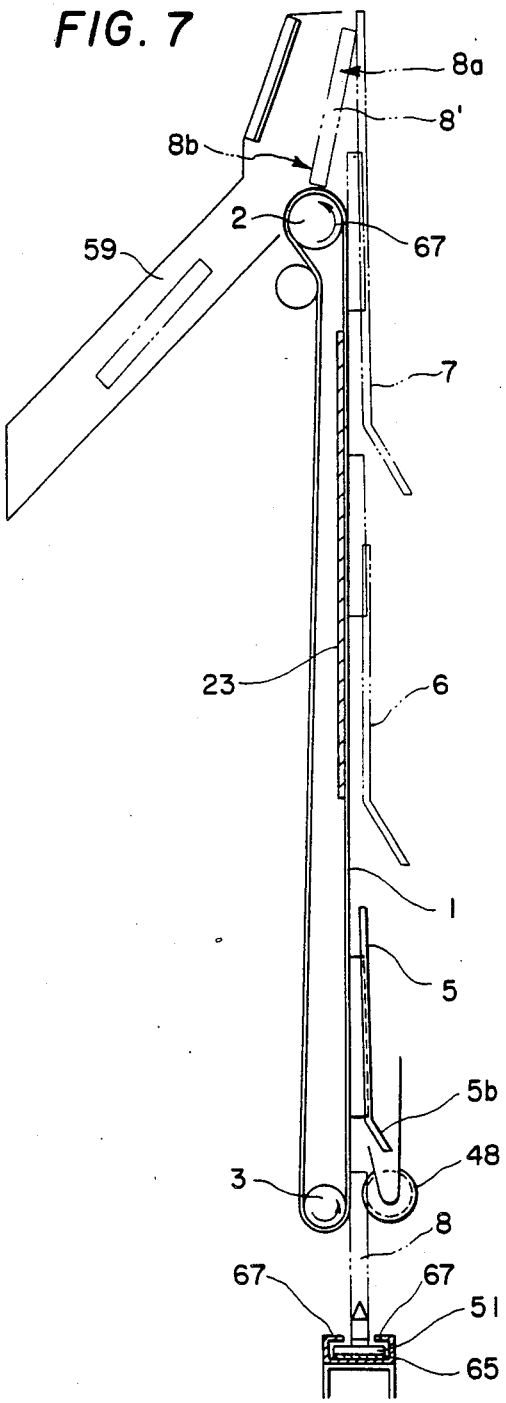
FIG. 7 illustrates separation and upward conveyance of an empty bobbin.

The mode of operation of the bobbin removing apparatus is described in the following: referring to FIGS. 1 and 7, a tray 51 carrying a standing empty bobbin 8 fitted thereon is conveyed out of a winder by a conveyor 65. Upon arriving at the bobbin-removing station, the tray is located in position by the action of a releasing and stopping device 66. It is noted that before reaching this position, the lower pulley 3 and the roller 48 are in the position indicated by the dash-and-two-dots lines 3*a*, 48*a*, respectively, in FIG. 1, and thus they are in opened relationship allowing the bobbin 8 to be conveyed. Subsequently, the type of tray is detected by the mark sensor, which controls the rotary solenoids 61, 29 of the chutes 58, 59 to switch them between "on" and "off" positions according to the type of tray detected, whereby the shiftable guides 62, 60 are correspondingly positioned. In addition, when sensors 63, 64 respond, the rotary solenoid 19 is switched "on" to actuate the lever 21 to rotate counterclockwise. When the lever reaches the position indicated by the solid line, the lower pulley 3 and the roller 48 are caused to shift to be in such positions that the bobbin 8 is tightly caught between them, as shown in FIG. 7. Under this conditions, the bobbin 8 is separated from the tray 51 and conveyed upwards to pass between the belt 1 and the guide 5. Then, the tray 51 is prevented from getting away from the conveyor belt 65 by blocking plates 67, 67. In this way, the bobbin 8 only is released.

Figure 6:
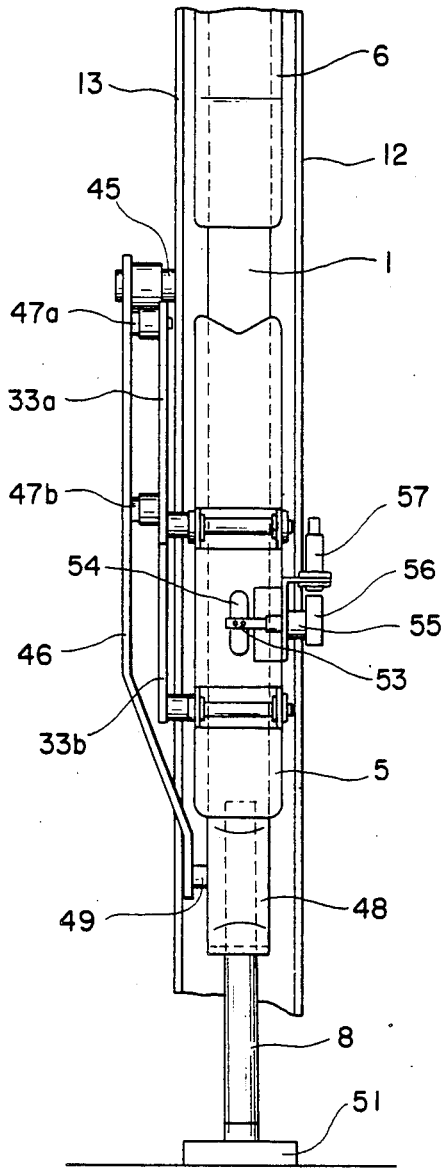
FIG. 6 is a partial side view.

When the bobbin 8 is rising between the belt 1 and the lower guide plate 5, the guide plate 5 is forced to make a parallel displacement dependent on the thickness of the bobbin 8 by means of the links 33*a*, 33*b* away from the belt 1 against the spring 68 to thereby form a path along which the bobbin pass. Reference character 5*b* designates the inclined portion of the guide plate 5 formed at the lower opening of the path. When an empty bobbin 8 rises between the guide plate 5 and the belt 1, the feeler 53 shown in FIG. 6 is not displaced, and accordingly the middle guide plate 6 remains at the position indicated by the solid line in FIG. 1. Therefore, the empty bobbin 8 passes upwards between the guide plate 6 and the belt 1 and then between the guide plate 7 and the belt 1. Upon reaching the position of the upper pulley 2, the leading end 8*a* of the empty bobbin 8′ rises along the guide plate 7 while the tailing end 8*b* follows the belt 1 around the pulley 2, as depicted by the dash-and-two-dots line in FIG. 7. The bobbin in turn drops down the chute 59, guided to the corresponding branch path by means of the variable guide plate 60 shown in FIG. 9, and delivered in the empty bobbin store box or to another conveyor.

Figure 8:
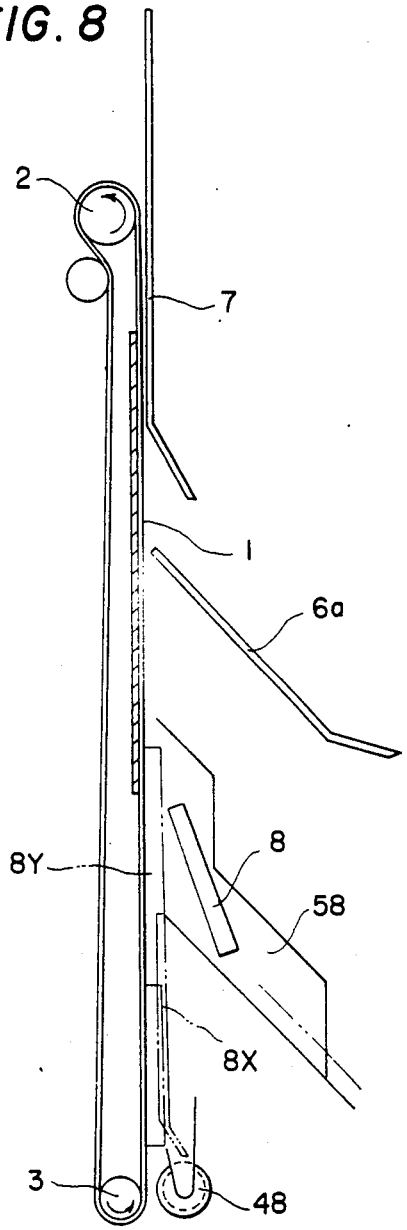
FIG. 8 illustrates the separation and delivery of a bobbin carrying very little thread thereon.

In addition, as above-described, when a bobbin carrying a small amount of remaining yarn thereon passes by the lower guide plate 5, the yarn wound on a portion of the bobbin is caught by the brush which projects somewhat from the guide plate 5 towards the belt. Consequently the rotating shaft 55 (FIG. 6) on which the brush is fixedly mounted is caused to rotate and thus actuates the approach sensor 57. The rotary solenoid 42 for actuating the guide plate 6 is thereby excited, resulting in the counterclockwise turning of the lever 43 about the output shaft 69, and in the shift of the link 34*b* and the guide plate 6 to the positions indicated by the dash-and-two-dots lines, respectively. It should be noted that the link 34*a* never turns because the guide plate carrying shaft and the output shaft are in the same position. Under this circumstance, as shown in FIG. 8, when a bobbin 8X further rises and reaches the region of the middle guide plate where no force pushes the bobbin against the belt 1, the bobbin 8Y indicated by the dash-and-two-dots line in FIG. 8 falls down the chute 58. A rightward protuberance on the belt 1 associated with the pression against the back of the belt by a roller provided at the position of the chute 58 in FIG. 1 forces the bobbin to be removed from the belt conveyance surface and fall down the chute 58 when the bobbin pass by the guide plate 5. If the movable guide 62 in the chute 58 has previously been moved to the specified position according to the kind of tray in FIG. 9, bobbins with a very small amount of remaining yarn thereon can be sorted, and accordingly stored and conveyed separately.

In FIG. 1, a bobbin carrying a large amount of remaining yarn thereon normally passes the bobbin removing station. When such a bobbin is removed owing to erronous detection, it passes between the belt 1 and the guide plates 5, 6 and 7 in the manner shown in FIG. 4: for example, the upper guide plate 7 is adequately displaced from the belt by virtue of the great turning of the links 35*a*, 35*b* to the dash-and-two-dots line positions 35*a*′, 35*b*′ to permit the conveyance of the bobbin, thus contributing to prevention of trouble with the bobbin removing apparatus. FIG. 4 illustrates the conveyance of a bobbin with a thick yarn layer between the belt 1 and the guide plate 6.

Figure 9:
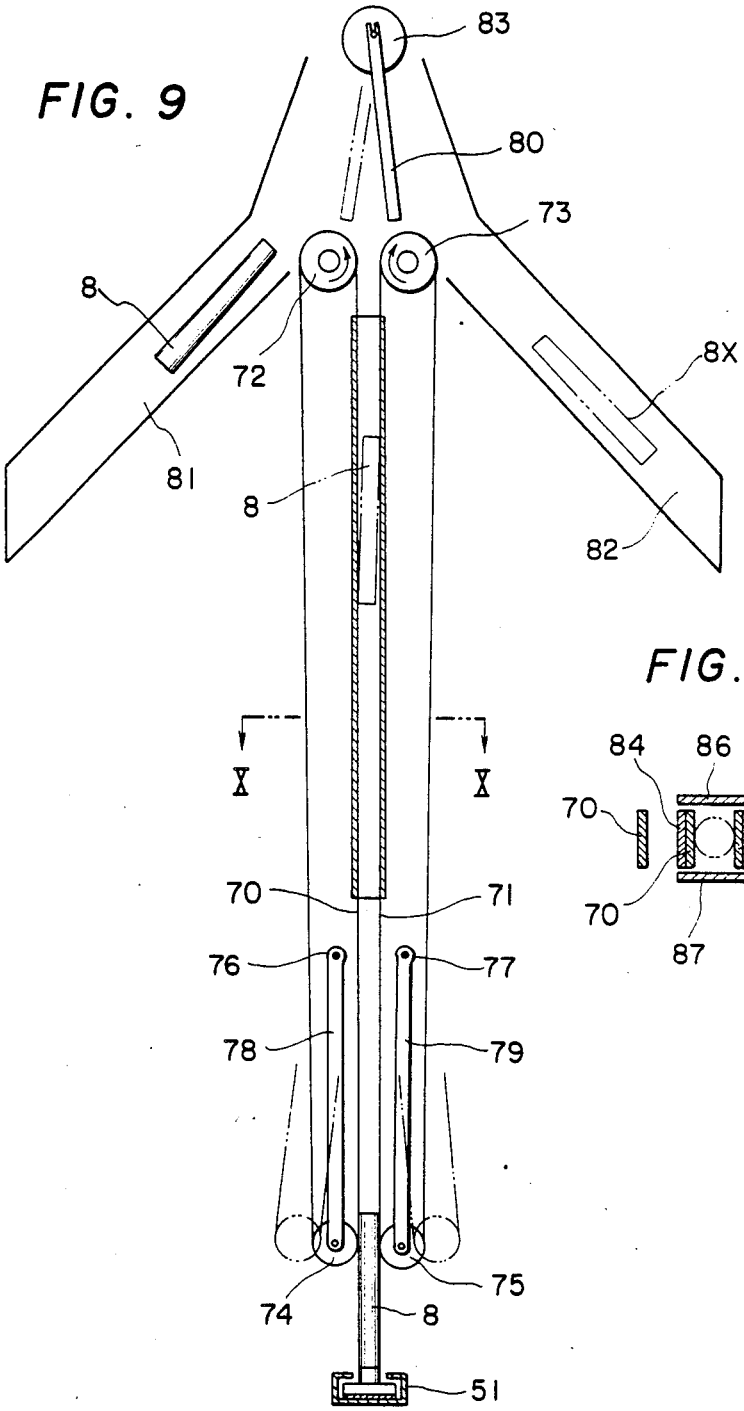
FIG. 9 is an elevational view schematically illustrating an alternative embodiment of the invention.
Figure 10:
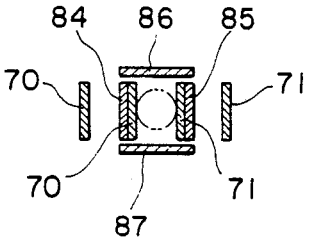
FIG. 10 is a cross-sectional view taken along line X—X of FIG. 9.

FIG. 9 illustrates an alternative embodiment of the invention. There are provided a pair of belts 70, 71 running vertically for removing bobbins 8 from trays 51 by catching them between the belts. The belts 70, 71 are carried by upper pulleys 72, 73 and lower pulleys 74, 75, respectively. The lower pulleys 74, 75 are connected to movable arms 78, 79 caused to open and close by the action of rotary solenoids or the like. Above the upper end of the belt, there are further provided a movable guide 80 and chutes 81, 82 for sorting empty bobbins 8 and bobbins 8X carrying a very small amount of yarn thereon. A rotary solenoid 83 operates according to the result of previous detection of the remaining yarn on the bobbin by a photoelectric tube or a brush feeler described in the preceding embodiment. Referring to FIG. 10, which is a cross-sectional view taken along line X—X of FIG. 9, the belts 70, 71 have guide plates 84, 85 on the back, respectively, and further guide plates 86, 87 on the other sides to form a bobbin conveyance path surrounded with belts 70, 71 and guide plates 86, 87. Besides, it may be chosen whether one belt only is driven by a motor and the other belt runs freely or both belts are synchronously driven. In addition, instead of the belts, a pair of rollers can be used which abut on the periphery of the bobbin and roll in the direction of the axial center of the bobbin to remove the bobbin from the tray.

The present invention, in which bobbins are separated from trays and conveyed while tightly caught between a belt running vertically and guide members along and adjacent the conveyance surface of the belt, presents several advantages in comparison with the prior art technique consisting of removing bobbins previously by chucking them. In the present invention there is no need to specify the longitudinal position at which a bobbin should be chucked and bobbins having different lengths are easily accommodated. Further advantages reside in that that different types of bobbins may be handled, that each removing cycle can be accomplished in reduced time, and that the throughput is at least 2 to 3 times greater as compared with the chuck mold.

What is claimed is:

1. A bobbin removing apparatus for removing a bobbin from a bobbin conveying medium, the apparatus comprising an endless belt having a conveyance surface and a bobbin guide member in spaced relationship to said belt, said apparatus being constructed to enable a bobbin to be tightly caught between said belt and said guide member and removed from said bobbin conveying medium by utilization of the conveyance surface of said belt, wherein said bobbin guide member comprises;

a roller in spaced relationship to said belt, said apparatus further comprising means for selectively adjusting the distance between said roller and said belt, whereby said roller and a portion of said belt are operable to be selectively brought into contact with a bobbin positioned between said roller and said belt.

2. A bobbin removing apparatus for removing a bobbin from a bobbin conveying medium, the apparatus comprising an endless belt having a conveyance surface wound around upper and lower pulleys, means for removing a bobbin from said bobbin conveying medium, a plurality of guide plates which are provided along and adjacent the conveyance surface of the belt for forcing the bobbin against the belt, and a chute for discharging the bobbin moved by means of the belt and the guide plates, wherein said means for removing a bobbin from said bobbin conveying medium comprises;

a roller in spaced relationship to said lower pulley, means for selectively adjusting the distance between said roller and said lower pulley, whereby said roller and a portion of said belt wound around said lower pulley are operable to be selectively brought into contact with a bobbin positioned between said roller and said lower pulley.

3. A bobbin removing apparatus as claimed in claim 2, wherein a belt guide plate is provided on the back of said belt opposite to the conveyance surface for preventing the belt from being flexed.

4. A bobbin removing apparatus for removing a bobbin from a bobbin conveying medium, the apparatus comprising an endless belt having a conveyance surface wound around upper and lower pulleys, means for removing a bobbin from said bobbin conveying medium, a plurality of guide plates which are provided along and adjacent the conveyance surface of the belt for forcing the bobbin against the belt, a chute for discharging the bobbin moved by means of the belt and the guide plates, and a swinging plate which is swingable with respect to the belt, wherein said means for removing a bobbin comprises the lower pulley with the belt which is pivotally connected to the lower end of a movable bracket and a roller which is mounted rotatably on a lower end portion of the swinging plate to force the bobbin against the belt, said roller surface being provided with a groove having a bow-shaped cross-section.

5. A bobbin removing apparatus as claimed in claim 2, wherein said guide plates comprise an upper guide plate, a middle guide plate and a lower guide plate and each of said guide plates is displaceable relative to the conveyance surface through the intermediation of a pair of turnable links.

6. A bobbin removing apparatus as claimed in claim 5 further comprising a frame element, wherein said upper guide plate is pivotally connected to one-end of the turnable links pivoted on shafts journalled in the frame element and urged towards the conveyance belt surface by a spring provided between the links and the frame element.

7. A bobbin removing apparatus for removing a bobbin from a bobbin conveying medium, the apparatus comprising an endless belt having a conveyance surface wound around upper and lower pulleys, means for removing a bobbin from said bobbin conveying medium, a plurality of guide plates which are provided along and adjacent the conveyance surface of the belt for forcing the bobbin against the belt, a frame element, a chute for discharging the bobbin moved by means of the belt and the guide plates, wherein said guide plates comprise an upper guide plate, a middle guide plate and a lower guide plate and are each designated displaceable parallel to the conveyance surface through the intermediation of a pair of links, wherein one link of said middle guide plate is mounted on a shaft journalled in the frame element and the other link is mounted on a shaft journalled in the arm of a first rotary solenoid so that the lower end of the middle guide plate is turnable away from the belt.

8. A bobbin removing apparatus for removing a bobbin from a bobbin conveying medium, the apparatus comprising an endless belt having a conveyance surface wound around upper and lower pulleys, means for removing a bobbin from said bobbin conveying medium, a plurality of guide plates which are provided along and adjacent the conveyance surface of the belt for forcing the bobbin against the belt, a chute for discharging the bobbin moved by means of the belt and the guide plates, a swinging plate which is swingable with respect to the belt, wherein said guide plates comprise an upper guide plate, a middle guide plate and a lower guide plate and are each displacable parallel to the conveyance surface through the intermediation of a pair of links, wherein said lower guide plate is turnable with the swinging plate and has a guide surface of circular arc in cross-section, at the center of which there is provided a feeler for detecting a bobbin with a very small amount of remaining yarn thereon.

9. A bobbin removing apparatus as claimed in claim 8, wherein a middle chute for discharging the bobbin with a very small amount of remaining yarn is provided between the middle guide plate and the lower guide plate.

10. A bobbin removing apparatus as claimed in claim 9, wherein said chute and said middle chute are constructed to be bifurcated chutes respectively, consisting of two chute members and a shiftable guide located at the juncture of the chute members, the shiftable guide being selectively shiftable between two positions to thereby selectively guide the bobbins into one or the other of said chute members.

11. A bobbin removing apparatus comprising a pair of running belts carried by upper pulleys and lower pulleys, respectively, for removing bobbins from trays by catching the bobbins between the belts, said lower pulleys being connected to movable arms which are operable to be opened to allow the introduction of a bobbin therebetween and closed to catch a bobbin therebetween, first guide plates provided on the back of the belts, second guide plates on both sides of the belts to form a bobbin conveyance path surrounded with the belts and guide plates, a feeler provided along the belts for detecting remaining yarn present on the bobbin, a movable guide for sorting bobbins carrying a very small amount of remaining yarns thereon, and chutes for discharging the empty bobbins and for discharging the sorted bobbins with remaining yarns.

* * * * *